US008387372B2

(12) United States Patent
Tewari et al.

(10) Patent No.: US 8,387,372 B2
(45) Date of Patent: Mar. 5, 2013

(54) PARTICULATE FILTER SYSTEM

(75) Inventors: Asim Tewari, Bangalore (IN); Garima Bhatia, Bangalore (IN)

(73) Assignee: GM Global Technology Operations LLC, Detroit, MI (US)

( * ) Notice: Subject to any disclaimer, the term of this patent is extended or adjusted under 35 U.S.C. 154(b) by 302 days.

(21) Appl. No.: 12/721,635

(22) Filed: Mar. 11, 2010

(65) Prior Publication Data

US 2011/0219753 A1 Sep. 15, 2011

(51) Int. Cl.
*F01N 3/00* (2006.01)

(52) U.S. Cl. ..... 60/297; 60/286; 60/287; 60/303

(58) Field of Classification Search ..... 60/297
See application file for complete search history.

(56) References Cited

U.S. PATENT DOCUMENTS 4,709,547 A 12/1987 Pischinger et al.
4,730,455 A 3/1988 Pischinger et al.
4,897,096 A 1/1990 Pischinger et al.
5,085,049 A * 2/1992 Rim et al. ..... 60/274
5,974,791 A * 11/1999 Hirota et al. ..... 60/276
6,090,187 A * 7/2000 Kumagai ..... 95/278
6,694,727 B1 * 2/2004 Crawley et al. ..... 60/295
6,770,116 B2 * 8/2004 Kojima ..... 95/14
6,820,417 B2 * 11/2004 May et al. ..... 60/297
2003/0066287 A1 * 4/2003 Hirota et al. ..... 60/297
2005/0284139 A1 * 12/2005 Verkiel et al. ..... 60/297
2006/0059899 A1 * 3/2006 Bailey ..... 60/296
2008/0034719 A1 * 2/2008 Han et al. ..... 55/524
2008/0087101 A1 * 4/2008 Konstandopoulos ..... 73/861.42
2009/0031712 A1 * 2/2009 McGinn et al. ..... 60/299
2009/0113883 A1 5/2009 Bhatia et al.
2010/0186385 A1 7/2010 Gonze et al.

* cited by examiner

*Primary Examiner* — Thomas Denion
*Assistant Examiner* — Jason Shanske

(57) ABSTRACT

A device for filtering particulates from an exhaust gas feed-stream of an internal combustion engine includes a filter substrate having a multiplicity of alternately closed parallel flow passages having porous walls oriented parallel to a flow axis of the exhaust gas between an inlet and an outlet thereof, wherein subsets of the flow passages are associated with respective ones of a plurality of zones, a flow control valve to control flow of exhaust gas to each of the plurality of zones, a multi-zone heating element including a plurality of individually activated heating elements each corresponding to one of the plurality of zones.

9 Claims, 5 Drawing Sheets

PARTICULATE FILTER SYSTEM

TECHNICAL FIELD

This disclosure relates to exhaust aftertreatment systems, and more specifically to monitoring a particulate filter of an exhaust aftertreatment system.

BACKGROUND

The statements in this section merely provide background information related to the present disclosure and may not constitute prior art.

An aftertreatment system for managing and treating an exhaust gas feedstream can include a particulate filter device that removes particulate matter, e.g., elemental carbon particles from the feedstream. Known applications for a particulate filter device include internal combustion engines operating lean of stoichiometry, including, e.g., compression-ignition (diesel) engines and lean-burn spark-ignition engines. Known particulate filter devices require periodic regeneration to oxidize and remove the filtered particulate matter from the particulate filter device. Regeneration can require operations that increase temperature of the particulate filter device. Increasing temperature of the particulate filter device can include increasing temperature of the exhaust gas feedstream, including, e.g., operating the internal combustion engine at a rich air/fuel ratio under high speed/high load operating conditions, and injecting hydrocarbons into the exhaust gas feedstream upstream of an oxidation catalyst that is upstream of the particulate filter device, among other operations. Such operations can have associated fuel penalties. It is also known that high temperature operation of particulate filter devices can reduce service life thereof.

SUMMARY

A device for filtering particulates from an exhaust gas feedstream of an internal combustion engine includes a filter substrate having a multiplicity of alternately closed parallel flow passages having porous walls oriented parallel to a flow axis of the exhaust gas between an inlet and an outlet thereof, wherein subsets of the flow passages are associated with respective ones of a plurality of zones, a flow control valve to control flow of exhaust gas to each of the plurality of zones, a multi-zone heating element including a plurality of individually activated heating elements each corresponding to one of the plurality of zones.

BRIEF DESCRIPTION OF THE DRAWINGS

One or more embodiments will now be described, by way of example, with reference to the accompanying drawings, in which.

DETAILED DESCRIPTION

Figure 1:
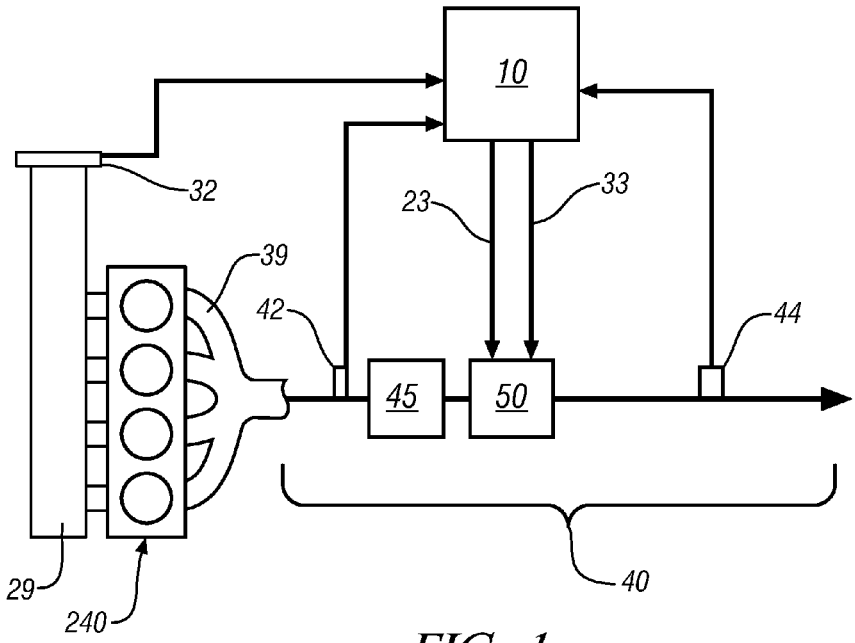
FIGS. 1-3 are two-dimensional schematic diagrams of an internal combustion engine, an exhaust aftertreatment system, and elements thereof, in accordance with the present disclosure.

Referring now to the drawings, wherein the showings are for the purpose of illustrating certain exemplary embodiments only and not for the purpose of limiting the same, FIG. 1 schematically illustrates an exhaust aftertreatment system 40 and an accompanying control system executed in a control module 10 that has been constructed in accordance with an embodiment of the disclosure. The exhaust aftertreatment system 40 is depicted as being fluidly coupled to an exhaust manifold 39 of an internal combustion engine 240 in one embodiment, although the methods described herein are not so limited. Like numerals refer to like elements in the figures.

In one embodiment, the engine 240 is a multi-cylinder direct-injection four-stroke internal combustion engine that operates at a lean air/fuel ratio to generate mechanical power that can be transmitted to a driveline. An air intake system channels intake air to an intake manifold 29 which directs and distributes the air into an intake passage to each combustion chamber of the engine 10. The air intake system includes air flow ductwork and devices for monitoring and controlling the engine intake air flow. The devices preferably include a mass air flow sensor 32 for monitoring mass air flow through the engine 10 and intake air temperature. Other engine control devices, e.g., a throttle valve can control air flow to the engine 10. The engine 240 includes the exhaust manifold 39 that entrains exhaust gases from the engine 10 and channels the exhaust gas feedstream to the exhaust aftertreatment system 40.

The exhaust aftertreatment system 40 includes at least one particulate filter assembly 50 configured to remove particulate matter from the exhaust gas feedstream. In one embodiment, shown in FIG. 1, there is a first aftertreatment device 45 upstream of the particulate filter assembly 50. In one embodiment, the first aftertreatment device 45 includes an oxidation catalyst coupled to a NOx reduction device. The exhaust aftertreatment system 40 preferably includes a first sensor 42 configured to monitor an exhaust gas feedstream out of the engine 240, which can include one of an air/fuel ratio sensor or an exhaust gas constituent sensor. The exhaust aftertreatment system 40 preferably includes a second sensor 44 configured to monitor the exhaust gas feedstream downstream of the particulate filter assembly 50, which can include an exhaust gas constituent sensor in one embodiment. Signal outputs of the sensing device(s) are monitored by the control module 10 for feedback control monitoring and diagnostics. The first aftertreatment device 45 and the particulate filter assembly 50 can be assembled into structures that are fluidly connected and assembled in an engine compartment and a vehicle underbody.

The control system is executed as a set of control algorithms in the control module 10. Control module, module, controller, processor and similar terms mean any suitable one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs, combinational logic circuit(s), input/output circuit(s) and devices, appropriate signal conditioning and buffer circuitry, and other suitable components to provide the described functionality. The control module has a set of control algorithms, including resident software program instructions and calibrations stored in memory and executed to provide the desired functions. The algorithms are preferably executed during preset loop cycles. Algorithms are executed, such as by a central processing unit, and are operable to monitor inputs from sensing devices and other networked control modules, and execute control and diagnostic routines to control operation of actuators. Loop cycles may be executed at regular intervals, for example each 3.125, 6.25, 12.5, 25 and 100 milliseconds during ongoing engine and vehicle operation. Alternatively, algorithms may be executed in response to occurrence of an event. The control system can control operation of the engine 240 in one embodiment, including controlling operation at a preferred air-fuel ratio to achieve performance parameters related to operator requests, fuel consumption, emissions, and driveability, with the intake air flow controlled to achieve the preferred air-fuel ratio. Engine control can include periodically operating the engine 240 to regenerate the particulate filter assembly 50.

Figure 2:
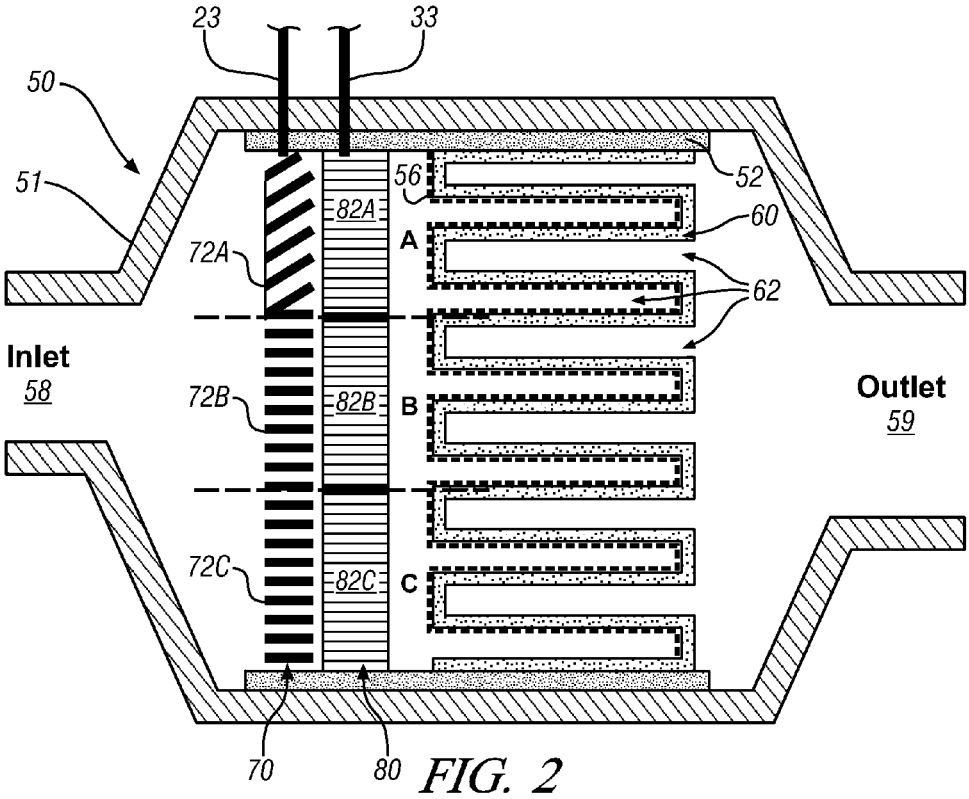

FIG. 2 schematically shows in two-dimensional detail an embodiment of the particulate filter assembly 50 configured to remove particulate matter from the exhaust gas feedstream. The particulate filter assembly 50 includes a particulate filter substrate 60 that is structurally housed in a metallic container 51 having an inlet 58 and an outlet 59. The inlet 58 fluidly connects to a fluidic outlet of the aftertreatment device 45. The outlet 59 fluidly connects to an exhaust pipe. Insulative support material 52 wraps around the filter substrate 60 and mechanically supports and secures the filter substrate 60 within the metallic container 51. The insulative support material 52 also provides a sealing function to ensure that the exhaust gas feedstream flows through the filter substrate 60.

In one embodiment, the filter substrate 60 can be coated with a catalyzed washcoat material 56, shown as applied on the inlet side of the filter substrate 60 in one embodiment. Preferred washcoat materials can include an alumina-based washcoat including catalytic metals, e.g., platinum, palladium, rhodium, and cerium.

The filter substrate 60 is preferably a monolith device having a honeycomb structure formed from extruded cordierite including a multiplicity of parallel flow passages 62 formed parallel to a longitudinal flow axis between the inlet 58 and the outlet 59. Walls of the filter substrate 60 formed between the flow passages 62 by the extruded cordierite are porous. Each of the flow passages 62 is preferably closed at one end. Preferably the flow passages 62 are alternately closed at an end of the filter substrate 60 facing the inlet 58 and at an end of the filter substrate 60 facing the outlet 59 in a checkerboard fashion. The alternately closed flow passages 62 cause the exhaust gas feedstream to flow through the porous walls of the filter substrate 60 as exhaust gas flows from the inlet 58 to the outlet 59 due to the pressure differential in the exhaust gas feedstream between the inlet 58 and the outlet 59 during engine operation. Flow of the exhaust gas feedstream through the porous walls of the filter substrate 60 serves to filter or strip particulate matter out of the exhaust gas feedstream and bring the exhaust gas feedstream in close proximity to the washcoat. The filter substrate 60 is preferably formed from cordierite, and alternatively other filtering substrate materials including SiC can be used in place of cordierite in the filter substrate 60 having the wall-flow design described herein.

Figure 3:
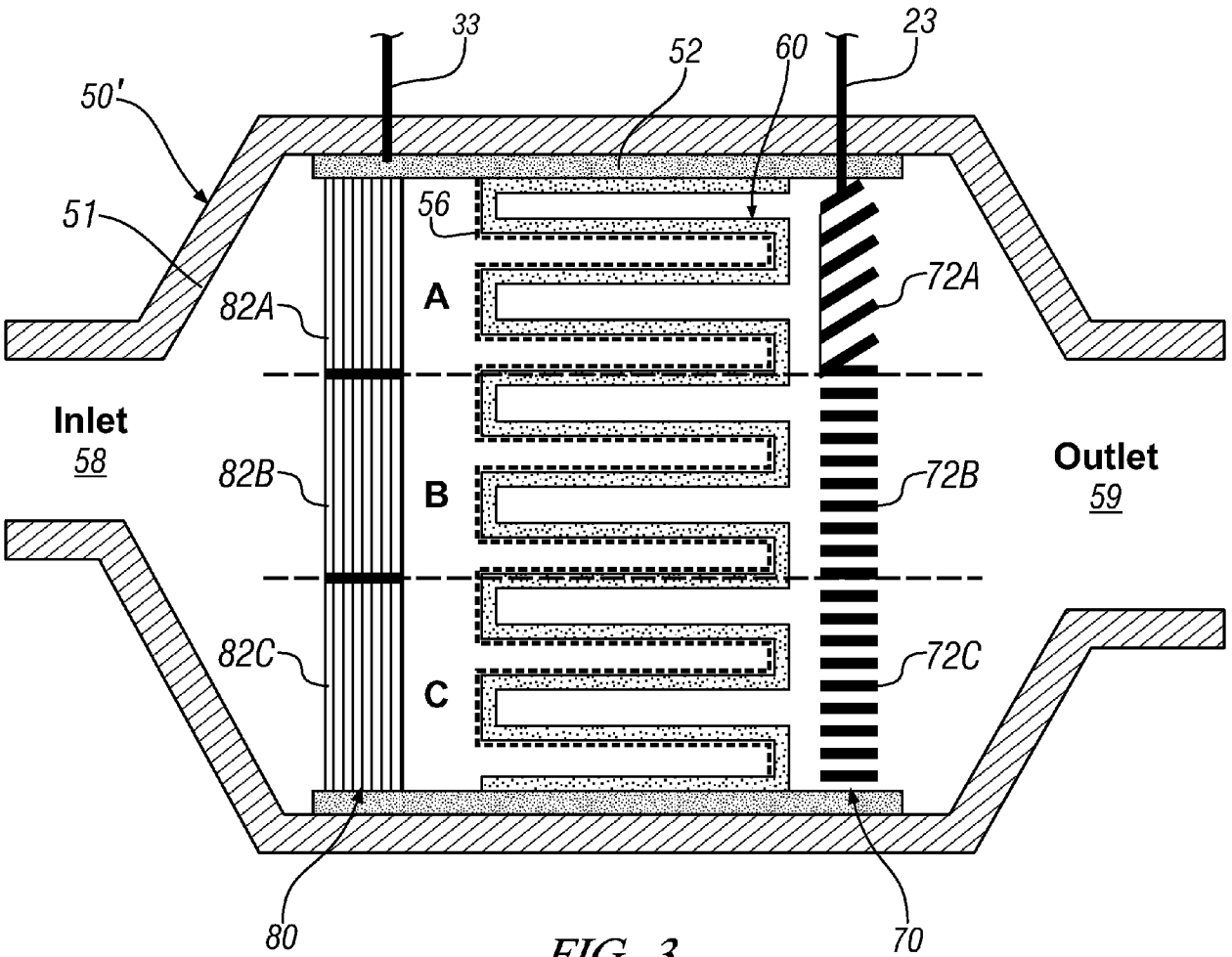

The flow passages 62 are separated into a plurality of zones, and each of the parallel flow passages 62 preferably associated with only one of the zones. There are three zones in the embodiments illustrated in FIGS. 2 and 3, depicted as zones A, B, and C, with each of the flow passages 62 preferably associated with only one of the zones A, B, and C. Other embodiments, including those shown with reference to FIGS. 4, 5, and 6, can include other quantities of zones. Preferably each of the zones, e.g., zones A, B, and C shown in the embodiments of FIGS. 2 and 3, have substantially the same quantity of flow passages 62 associated therewith.

A flow control valve 70 includes a plurality of flow control devices, depicted as 72A, 72B, and 72C in this embodiment, that are operatively connected to the control module 10 via an electric cable 23. Each of the flow control devices 72A, 72B, and 72C physically corresponds to and is associated with one of the plurality of zones A, B, and C. The flow control devices 72A, 72B, and 72C are preferably flow dampening devices that can be applied to obstruct and thus restrict mass flowrate of the exhaust gas feedstream through a selected one of the zones A, B, and C. Each of the flow control devices 72A, 72B, and 72C can include a shutter device, mesh, valve, and other device that physically obstructs flow of exhaust gas to reduce the mass flowrate of the exhaust gas feedstream through flow passages 62 of an associated zone, i.e., one of zones A, B, and C. When activated, the selected flow control device, i.e., 72A, 72B, and 72C obstructs flow of the exhaust gas feedstream through the flow passages 62 of the associated zone such that the mass flowrate of the exhaust gas feedstream through the flow passages 62 of the associated zone is less than a threshold flowrate during ongoing vehicle operation. The threshold flowrate can be defined in terms of a space velocity, i.e., a volumetric exhaust gas flowrate per volume of flow passages 62 associated with one of the zones A, B, and C having units of L/h/L, or 1/h. In one embodiment the threshold flowrate is in terms of a mass flowrate having units of kg/h, e.g., 100 kg/h. When deactivated, there is no obstruction of flow of the exhaust gas feedstream through the associated zone. The flow control valve 70 including the plurality of flow control devices 72A, 72B, and 72C is placed upstream of the filter substrate 60 in this embodiment. Preferably, the flowrate threshold is a maximum flowrate at which the exhaust gas feedstream flowing through the associated zone can achieve a temperature that is greater than 600° C. when the associated heating element segment is powered at a predetermined power level, e.g., 2 kW. FIG. 3 shows an embodiment of the particulate filter assembly 50' with the flow control valve 70 including the plurality of flow control devices 72A, 72B, and 72C placed downstream of the filter substrate 60.

A multi-zone heating element 80 is placed upstream of the filter substrate 60. The heating element 80 preferably includes individually activated electrically powered heating element segments 82, depicted as 82A, 82B, and 82C in this embodiment. The heating element segments 82 are individually activated by the control module 10 via a plurality of cables 33 that control electric power transfer to each of the heating element segments 82 using electric switch devices, e.g., power transistor devices. The plurality of heating element segments 82, i.e., 82A, 82B, and 82C physically correspond to and are associated with the plurality of zones of the flow passages 62 of the filter substrate 60, i.e., zones A, B, and C in this embodiment. The heating element segments 82 are preferably electrically powered resistive-type heating devices that can be selectively actuated to generate heat which can be convectively transferred to the corresponding flow passages 62 associated with one of zones A, B, and C via the exhaust gas feedstream. In one embodiment, the heating element segments 82 of the heating element 80 are resistive elements connected to a ceramic monolith substrate having flowthrough passages that are placed contiguous to and upstream of the filter substrate 60. In one embodiment, the heating element segments 82 of the heating element 80 are positive-temperature coefficient ceramic devices formed into a substrate having flowthrough passages. The control module 10 is configured to transfer electric power to individual ones of the heating element segments 82 via the plurality of electric cables 33 using power transistor devices and other control mechanisms.

In operation, the control module 10 executes a control scheme that sequentially activates one of the heating element segments 82 and the corresponding one of the flow control devices 72 to effect regeneration of the flow passages associated with the corresponding zone, e.g., one of the zones A, B, and C. The system operation acts to increase temperature within the flow passages associated with the selected zone by increasing temperature of the exhaust gas feedstream using the associated heating element segment 82 and decreasing the exhaust gas flowrate therethrough by restricting flow with the flow control device 72. Heat transfer equations can be used to determine preferred electric power for heating one of the heating element segments 82 to achieve an exhaust gas feedstream temperature that effectively regenerates the selected zone associated with selected flow passages. In one embodiment, power consumption for one of the heating element segments 82 is 2 kW, operating for a duration of sixty seconds to achieve a temperature greater than 600° C. in the exhaust gas feedstream leading to 75% to 90% regeneration of the particulate filter 60.

Figure 4:
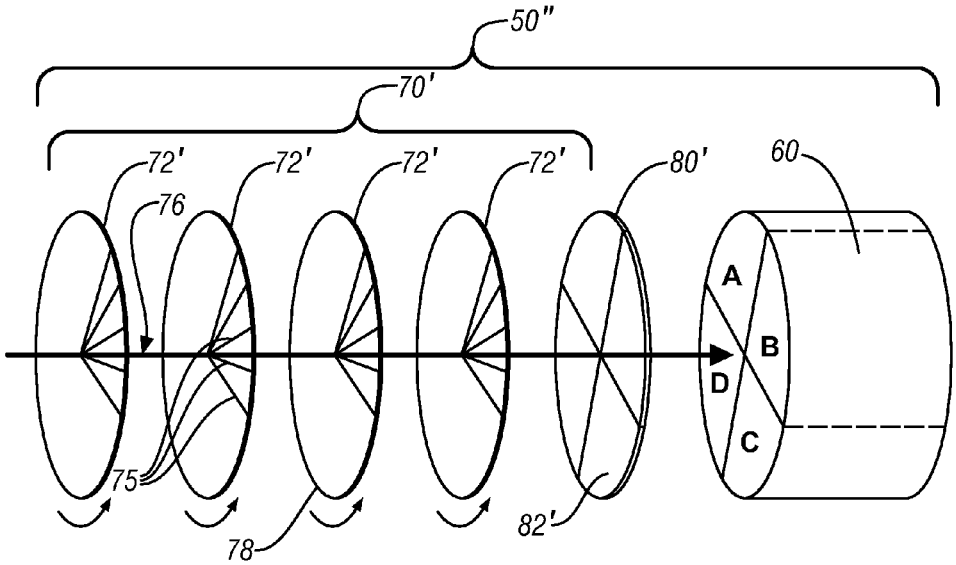
FIG. 4 is a three-dimensional schematic diagram of an exhaust aftertreatment system, and elements thereof, in accordance with the present disclosure.

FIG. 4 shows a partial three-dimensional exploded side view of an embodiment of a particulate filter assembly 50" with filter substrate 60, flow control valve 70', and multi-zone heating element 80'. The filter substrate 60 is cylindrically shaped in the embodiment with four zones A, B, C, and D, each associated with one-fourth of the face of the filter substrate 60, with each of the four zones A, B, C, and D having substantially the same quantity of flowthrough passages associated therewith. The multi-zone heating element 80' is circular and has a diameter that is substantially equal to the cross-sectional diameter of the filter substrate 60. The multi-zone heating element 80' has four individually activated electrically powered heating element segments 82' corresponding to the four zones A, B, C, and D of the filter substrate 60.

The flow control valve 70' of this embodiment includes a plurality of coaxial flow control devices 72'. Each of the flow control devices 72' is a circular-shaped device having a plurality of flow restrictors 75 that project radially from a center point that is coaxial to a center axis 76 of the filter substrate 60 to a circumferential ring 78. The flow restrictors 75 for each of the flow control devices 72' are contained in arc segments that are associated with only one-fourth of the face of the filter substrate 60 in this embodiment. The flow control devices 72' are facially contiguous. The flow control devices 72' can each be individually rotated about the center axis 76 in response to a control signal from the control module 10. When the flow control devices 72' are all oriented in a first rotational position, flow restriction thereacross is minimized for a given pressure drop and flow rate. The flow control devices 72' can be individually rotated at different angles of rotation to obstruct flow across one of the heating element segments 82' associated with one of the four zones A, B, C, and D. The flow control devices 72' can all be rotated to obstruct flow across one of the arc segments associated with each of the four zones A, B, C, and D of the filter substrate 60.

Figure 5:
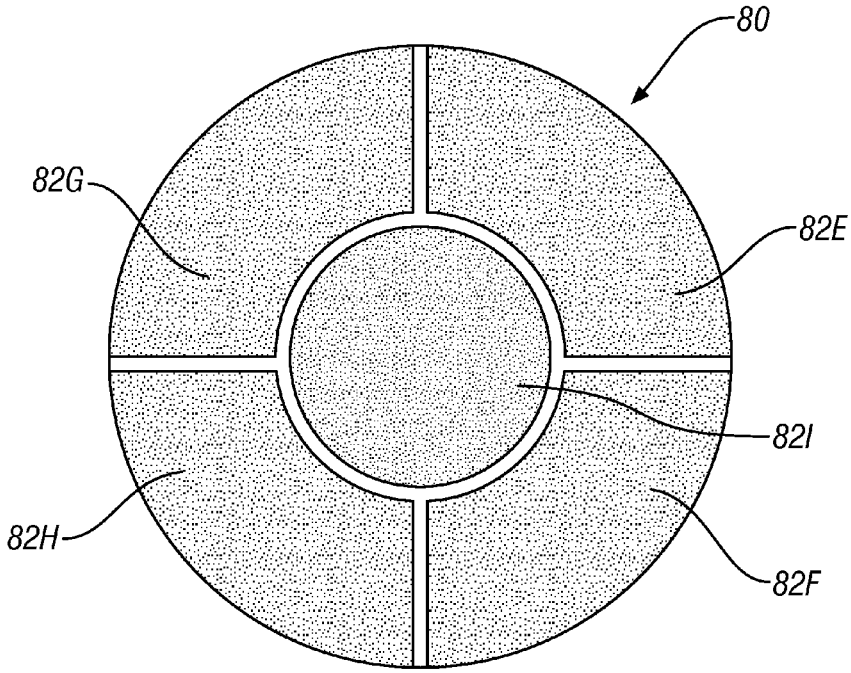
FIGS. 5 and 6 are two-dimensional schematic diagrams of multi-zone heating elements, in accordance with the present disclosure.

FIG. 5 shows a two-dimensional front view of an embodiment of the multi-zone heating element 80 having five individually activated electrically powered heating element segments 82E, 82F, 82G, 82H, and 82I. The heating element segments 82E, 82F, 82G, 82H, and 82I correspond to zones of parallel flow passages associated with a filter substrate, e.g., the filter substrate 60 shown in FIG. 4. Preferably the five heating element segments 82E, 82F, 82G, 82H and 82I have substantially identical surface areas, and thus the corresponding zones of the associated filter substrate each have substantially the same quantity of flowthrough passages associated therewith. The five heating element segments 82 include an annular ring that is divided into four segments 82E, 82F, 82G and 82H and surround a center ring 82I.

Figure 6:
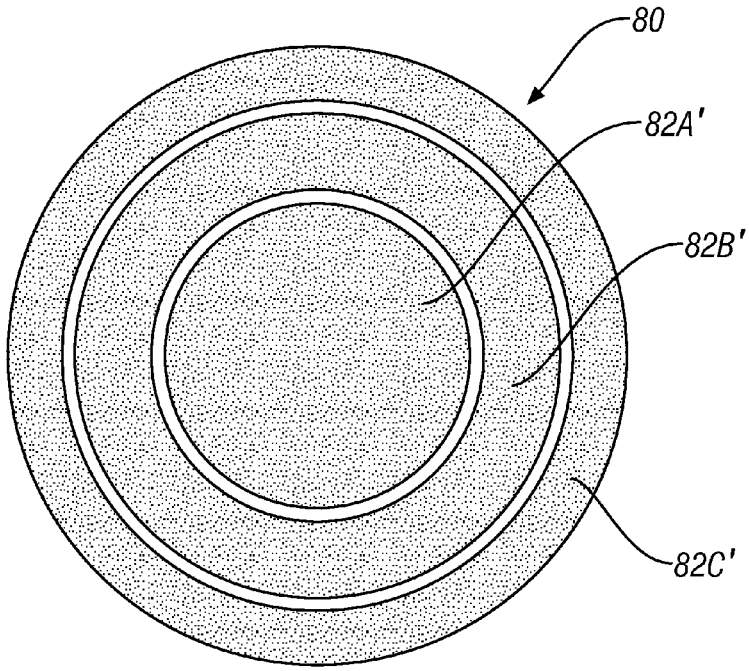

FIG. 6 shows a two-dimensional front view of an embodiment of a multi-zone heating element 80 having three individually activated electrically powered heating element segments 82A', 82B', and 82C'. The heating element segments 82A', 82B', and 82C' correspond to zones of parallel flow passages associated with a filter substrate, e.g., the filter substrate 60 shown in FIG. 4. The three heating element segments 82A', 82B', and 82C' as shown include a center, circular-shaped element 82A' and two coaxial annular ring elements 82B', and 82C' having substantially identical surface areas, and thus the corresponding zones of the associated filter substrate each have substantially the same quantity of flowthrough passages associated therewith. Other devices and systems can be used to transfer heat to selected zones of the filter substrate 60, including heating devices embedded into specific flowthrough passages 62, targeted microwave heating systems, and plasma heating systems.

A generalized mathematical model was formulated to describe heat transfer across a heating element including an electrical grid. The generalized mathematical model can be used to calculate heat transfer between a heating element, e.g., one of the heating element segments 82, and exhaust gas passing through it, preferably associated with regenerating flow passages associated with one zone of a filter substrate for a particulate filter. A primary mode of heat transfer is convective heat transfer from the heating element to the exhaust gas feedstream as it passes through. Assumptions to formulate the heating element model include that radial temperature and heat transfer effects between flow passages in the filter substrate are negligible. The material of the filter substrate is cordierite, which has relatively low thermal conductivity. Thus the characteristic time for radial heat transfer conduction is in the order of tens of minutes, which is substantially longer in elapsed time than a regeneration period for a filter substrate when applied to a powertrain system. Additional modes of heat transfer from the heating element include conduction due to direct contact with the front face of the filter substrate and radiation between the surface of the heating element and the front face of the filter substrate, each which have been shown to be substantially negligible. Thus, heat energy transfer between the heating element and the filter substrate can be described by a single convective heat transfer coefficient between the heating element and the exhaust gas feedstream, which can be fitted using experimentally derived data for a specific application.

The generalized mathematical model of Eq. [1] below is a transient energy equation for a heating element, e.g., one of the heating element segments 82 of the heating element 80, and takes into account the axial conduction in the material of the heating element, electric power input to the heating element which includes a source term, and forced convective heat transfer between the heating element and the exhaust gas. The electrical power input is multiplied with a correction term $\eta_{eff}$ which represents the efficiency of transfer of the electrical energy to the material of the heating element, after accounting for losses associated with the wiring harness. This is a fitting parameter in the model and must be tuned against available experimental data.

$$\rho_h C_{ph} \frac{\partial T_h}{\partial t} = \lambda_h \frac{\partial^2 T_h}{\partial z^2} + \frac{Q_h(t)\eta_{eff}}{V_h} - h_{conv} \frac{A_h}{V_h}(T_h - T_g) \quad [1]$$

Boundary conditions at the two ends of the filter substrate account for the convective losses from the heating surface and are given by the following:

$$\lambda_h \frac{\partial T_h}{\partial z} = -h_{amb}(T_h - T_{amb}) \quad [2]$$

which is calculated at atz=0, z=$L_h$

The energy balance for the gas phase describes the transient temperature change of the gas as it passes through the heating element material, and includes the axial flow of energy along flow passages of the heating element, as well as the convective transfer of energy due to the contact between the gas and the heating element as follows.

$$\rho_g C_{pg} \frac{\partial T_g}{\partial t} = -u_g \rho_g C_{pg} \frac{\partial T_g}{\partial z} + h_{conv} \frac{A_h}{V_h}(T_h - T_g) \quad [3]$$

Exhaust gas temperature at the entrance to the heating element is known and provides the boundary condition as follows.

$$T_g = T_{g,in} \text{ at } z=0 \quad [4]$$

The heat transfer coefficient between the heating element and the exhaust gas can be related to the Nusselt number as follows:

$$h_{conv} = \frac{Nu \cdot \lambda_g}{d_{hr}} \quad [5]$$

where $d_{hr}$ is the hole diameter representing the air gap between the adjacent flow passages of the heating element. The heat transfer correlation for forced convection heat transfer from a cylinder in perpendicular flow is used, which relates Nusselt number to the Reynolds and Prandtl numbers as follows:

$$Nu = c_1 \, Re^{1/2} \, Pr^{1/3} \quad [6]$$

where the adjustable parameter $c_1$ is used for fitting against experimental data.

The heating element model as described above contains two adjustable parameters $\eta_{eff}$ and $c_1$, which can be calibrated against a set of calibration runs, as described in the next section. Once fitted, these values are preferably kept constant for the subsequent predictions to be made using the heating element model.

Descriptors of the parameters, terms, and variables for the forgoing equations are as follows in Table 1.

TABLE 1

| Term | Description | Units |
|---|---|---|
| $A_h$ | Contact area of heating element surface with exhaust gas | $m^2$ |
| $c_1$ | Coefficient in Nusselt number correlation | — |
| $C_{pg}$ | Specific heat capacity of gas | J/kg/K |
| $C_{ph}$ | Specific heat capacity of heating element material | J/kg/K |
| $h_{conv}$ | Heat transfer coefficient between heating element and gas | $W/m^2/K$ |
| $L_h$ | Length (width) of heating element | m |
| Nu | Nusselt number | — |
| Pr | Prandtl number | — |
| $Q_h$ | Power input to heating element | W |
| Re | Reynolds number | — |
| $T_g$ | Gas temperature | K |
| $T_{g,in}$ | Exhaust gas temperature at the entrance of the heating element | K |
| $T_h$ | Temperature of heating element | K |
| $u_g$ | Gas phase velocity through heating element | m/s |
| $V_h$ | Volume of heating element material in each zone | $m^3$ |
| z | Axial length dimension of heating element | m |
| $\eta_{eff}$ | Efficiency of electric heating element | |
| $\lambda_h$ | Thermal conductivity of heating element material | W/m/K |
| $\rho_g$ | Density of gas flowing past heating element | $kg/m^3$ |
| $\rho_h$ | Density of heating element material | $kg/m^3$ |

Thus, for a known electric power input and exhaust gas flowrate, the temperatures of the heating element $T_h$ and the exhaust gas $T_g$ at the front face of the particulate filter can be calculated. The exhaust gas temperature is then used as the inlet condition for a 1-D regeneration model of a filter substrate for a particulate filter, along with exhaust gas flowrate and oxygen concentration, to obtain the results in terms of particulate matter oxidation, i.e., soot conversion, and internal temperatures of the filter substrate achieved during a regeneration process. The kinetic parameters of the particulate filter model were not tuned against data, and nominal values were used for the kinetic parameters for thermal oxidation.

Figure 7:
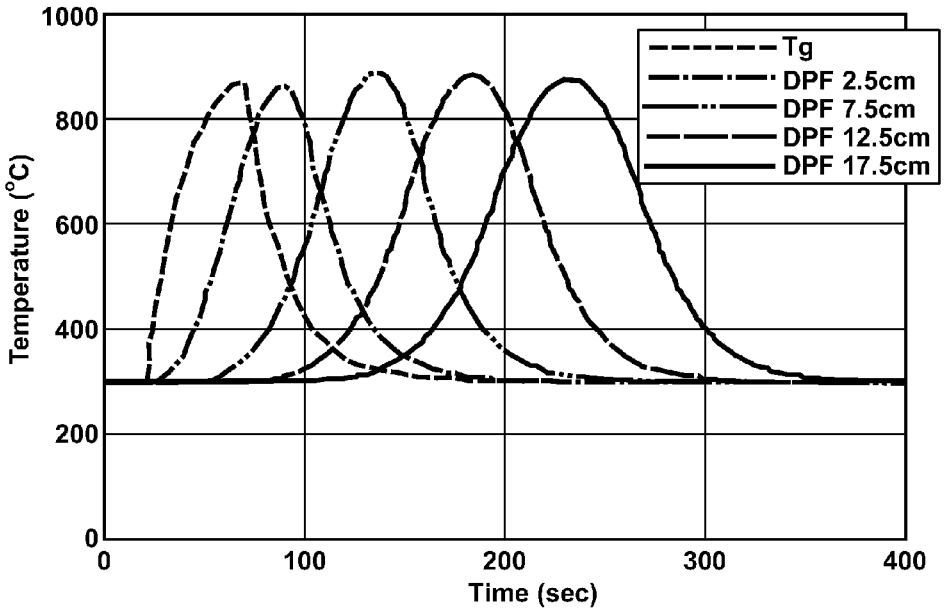
FIGS. 7-9 are datagraphs, in accordance with the present disclosure.
Figure 8:
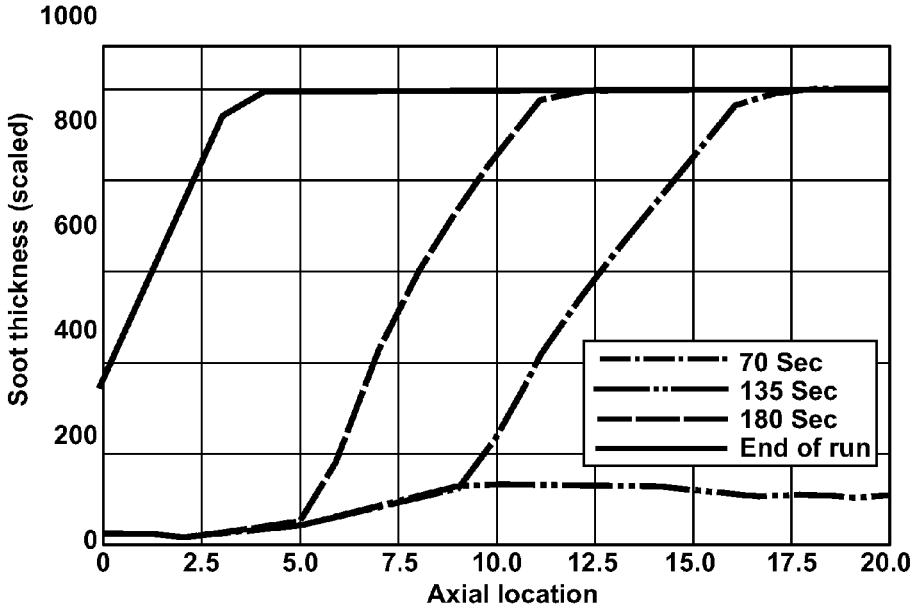
Figure 9:
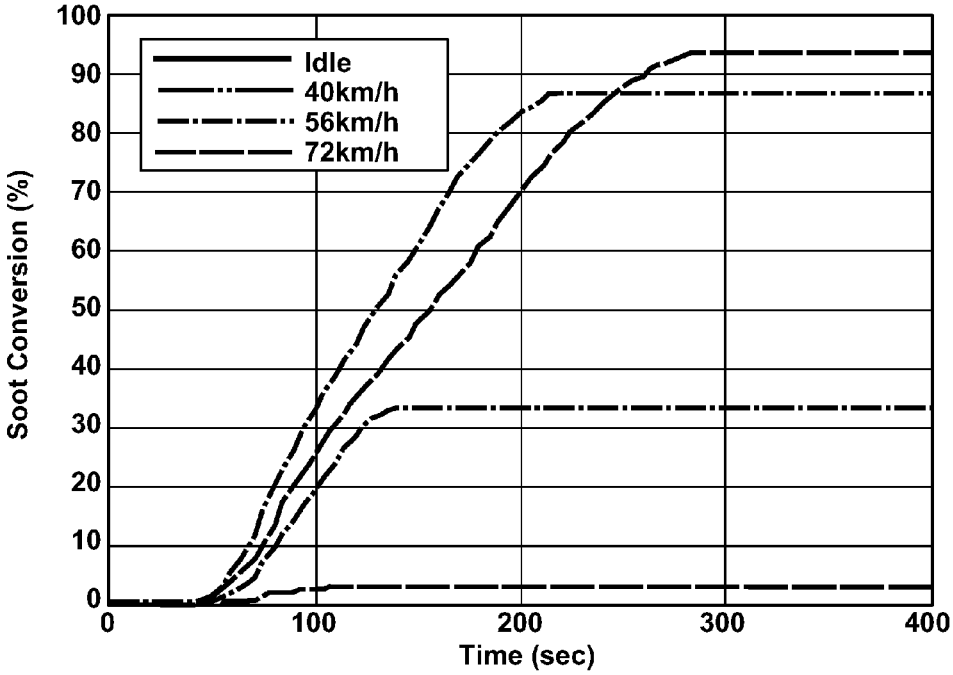

FIGS. 7, 8, and 9 graphically show results achieved using the aforementioned mathematical model described with reference to Eqs. 1-5, and calibrated against available data to obtain adjustable parameters $\eta_{eff}$ and $c_1$ to describe the heat transfer between the heating element and the exhaust gas feedstream. The model described with reference to Eqs. 1-5, above, was calibrated using the following fitted parameters in the heating element model.

$$\eta_{eff} = 0.8 \text{ and } c_1 = 2.28 \quad [7]$$

Temperature predictions were made for a range of operating conditions. All runs have been carried out at 5 g/L soot loading and 9% oxygen concentration, unless otherwise indicated. The heating element simulations are for power inputs of 2 kW and 3 kW per zone of a 3-zone heating element design.

FIG. 7 graphically shows results associated with operating an embodiment of a system as described above, including temperatures determined at specific locations relative to a front face of a filter substrate downstream of a heating element over an elapsed period of time. Temperature locations include temperatures at axial locations in the filter substrate relative to the heating element, including 2.5 cm (DPF 2.5 cm), 7.5 cm (DPF 7.5 cm), 12.5 cm (DPF 12.5 cm), and 17.5 cm (DPF 17.5 cm), and the exhaust gas feedstream temperature Tg. Operating conditions include a relatively low exhaust gas feedstream flowrate of 50 kg/hr, which is meant to simulate engine idle conditions. The filter substrate has a particulate matter loading of 5 g/L. The heating element is operated at a power input of 2 kW for 50 s. The filter substrate and the exhaust gas are both at 300° C. initially and the heating element grid is switched on at 20 seconds and switched off at 70 seconds. Results indicate the exhaust gas temperature entering the filter substrate and the temperature profiles inside the filter substrate at the four axial locations over time. Overall 91% soot conversion is achieved, with peak temperatures of 868° C., 891° C., 887° C. and 880° C. at the four axial locations inside the filter substrate. The maximum temperature inside the filter substrate occurs near the axial center of the filter substrate. This results from the power input to the heating element being deactivated after 70 seconds when the inlet exhaust temperature drops back down to 300° C. and when the center of the filter substrate has reached its peak temperature.

FIG. 8 graphically shows results associated with operating an embodiment of the system as described above, including axial profiles including a relative soot layer thickness (Soot thickness (scaled)) at various elapsed periods of time during regeneration for the system, measured at axial distances from a front face of the filter substrate. When the heating element is deactivated at 70 seconds (70 sec), there is an overall regeneration of 5%, with only a front portion of the filter substrate showing some soot layer depletion. However, energy released due to initial soot oxidation propagates a regeneration front axially through the filter substrate, with subsequent soot thickness profiles determined after 135 seconds (135 sec), 180 seconds (180 sec) and at an end of the test run (400 seconds) representing overall soot conversion levels of 37%, 57% and 91% respectively. The low flow rate (50 kg/hr) associated with regeneration decreases the rate of dissipation of the heat released from the exothermic oxidation reaction.

FIG. 9 graphically shows results associated with operating an embodiment of the system as described above, including overall particulate matter conversion (Soot conversion (%)) associated with steady state operation at various elapsed periods of time during regeneration for the system at different vehicle speeds which are associated with different exhaust gas feedstream flowrates. The vehicle speeds include idle, 40 km/h (25 mph), 56 km/h (35 mph), and 72 km/h (45 mph), with corresponding exhaust gas feedstream flowrates of 50 kg/h, 70 kg/h, 130 kg/h, and 170 kg/h, and expected oxygen concentrations present in the engine exhaust at each speed and flowrate. This is shown in Table 2.

TABLE 2

| Vehicle speed km/h (mph) | Flow rate (kg/hr) | Flow rate (g/s) | Oxygen (%) |
|---|---|---|---|
| 0 (idle) | 50 | 13.89 | 14 |
| 40 (25) | 70 | 19.44 | 11 |
| 56 (35) | 130 | 36.11 | 9 |
| 72 (45) | 170 | 47.22 | 9 |

The results indicate that soot conversion is reduced with increased vehicle speed. These results contain the combined effect of three factors including temperature of the exhaust gas feedstream at the inlet to the filter substrate, exhaust gas flowrate and oxygen concentration. The increase in the exhaust gas flowrate past the heating element reduces the convective heat transfer from the heating element to the gas phase, due to the reduction in residence time of the gas in contact with the heating element surface area. This leads to a drop in peak temperature of the exhaust gas feedstream entering the filter substrate. Secondly, the increase in exhaust flow rate inside the filter substrate ensures that the heat release from the soot oxidation is efficiently dissipated and carried out of the filter substrate. Heat of reaction is one factor in propagating a soot oxidation front through each flow passage of the filter substrate after electric power to the heating element is deactivated. In contrast, during a high exhaust flow rate, a substantial portion of the heat of reaction is transferred out of the filter substrate along with the heated gas. Thirdly, the drop in oxygen concentration with increasing flow also plays a role, although to a much smaller extent than the other two factors. The rate of soot conversion increases between idle and 40 km/h (25 mph) vehicle speed, although the final conversion still follows the trend described above. This indicates there is an optimal exhaust gas feedstream flowrate for soot oxidation, and a soot oxidation front, once initiated, can progress more quickly down the channel, as long as the temperature is high enough to effect regeneration. An exhaust gas feedstream flowrate that is too high can dissipate energy and extinguish the soot oxidation front, as demonstrated by the 72 km/h (45 mph) case. Thus the increase in oxidation rate between idle and 25 mph is a flow effect, while the subsequent decrease in oxidation rate occurs due to the temperature drop associated with the higher flow rates of 35 and 45 mph. Thus, a skilled practitioner can determine a preferred exhaust gas feedstream flowrate and associated heat transfer for effective soot oxidation in a filter substrate, and control operation of the multi-zone heating element 80 and the flow control device 70 to effect regeneration in the zones of the filter substrate 60.

Therefore at high flow exhaust flow rates corresponding to high vehicle speed, electrical heating alone may be insufficient to ensure that a robust regeneration front is achieved which can lead to almost complete soot conversion. An additional energy input may be required at these high flow rates, either through post-injection of hydrocarbons coinciding with the electrical heating, or through an increase in the power provided to the heater element. The hydrocarbon injection has been represented as an elevated exhaust gas temperature at the heater inlet (450° C. compared to 300° C. earlier), coinciding with the power input to the heater element. Therefore, reducing flow to a portion of the parallel flow passages of the filter substrate 60 is a preferred way of regenerating the filter substrate 60 and oxidizing filtered particulate matter.

Furthermore, when the predicted output power request ($P_{pred}$) and the predicted vehicle speed ($V_{pred}$) indicate that vehicle speed is in a range that is greater than 40 km/h (25 mph), the flow control valve 70 can be controlled to obstruct flow through selected portions of the multi-zone heating element 80 to achieve a flowrate that can effect regeneration. This includes sequentially activating one of the zones of the multi-zone heating element 80 and controlling the flow control valve 70 to control exhaust gas flowrate to the corresponding zone of the filter substrate 60 to achieve an exhaust gas temperature that is greater than 600° C. for a predetermined period of time therein. This action of sequentially activating the individual zones of the multi-zone heating element 80 and controlling the flow control valve 70 to control the exhaust gas flowrate to the corresponding zone of the filter substrate 60 sequentially regenerates the zones of the filter substrate 60.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A device for filtering particulates from an exhaust gas feedstream of an internal combustion engine, comprising:

a filter substrate having a multiplicity of alternately closed parallel flow passages having porous walls oriented parallel to a flow axis of the exhaust gas between an inlet and an outlet thereof, wherein subsets of the flow passages are associated with respective ones of a plurality of zones;

a flow control valve to control flow of exhaust gas to each of the plurality of zones;

a multi-zone heating element including a plurality of individually activated heating elements each corresponding to one of the plurality of zones; and a control module configured to:

operate the flow control valve to obstruct the flow of exhaust gas through a selected one of the plurality of zones to achieve a low flowrate of the exhaust gas through said selected one of the plurality of zones and coincidently operate the multi-zone heating element to activate the one of the plurality of individually activated heating elements corresponding to said selected one of the plurality of zones; and then deactivate the heating element and continue to operate the flow control valve to obstruct the flow of exhaust gas through said selected one of the plurality of zones to achieve the low flowrate of the exhaust gas through said selected one of the plurality of zones;

wherein the low flowrate of the exhaust gas comprises a flowrate suitable to propagate a soot oxidation front through the subset of flow passages associated with said selected one of the plurality of zones after deactivating the heating element.

2. The device of claim 1, wherein operating the flow control valve to obstruct the flow of exhaust gas through said selected one of the plurality of zones and activation of said one of the plurality of individually activated heating elements corresponding to said selected one of the plurality of zones achieves an exhaust gas temperature greater than 600° C. through the selected one of the plurality of zones.

3. The device of claim 2, wherein the multi-zone heating element transfers heat to said selected one of the plurality of zones at a power consumption of 2 kilowatts.

4. The device of claim 1, wherein the filter substrate comprises cordierite material.

5. The device of claim 1, wherein the flow control valve is located upstream of the filter substrate.

6. The device of claim 1, wherein the flow control valve is located downstream of the filter substrate.

7. The device of claim 1, wherein each of the plurality of zones comprises a similar quantity of flow passages.

8. A particulate filter assembly, comprising:

a cordierite filter substrate having a plurality of filter zones;

a heating element including a plurality of individually activated heating zones each corresponding to a respective one of the plurality of filter zones;

a flow control valve for selectively obstructing flow of exhaust gas through each of the plurality of filter zones; and a control module configured to:

operate the heating element to activate the heating zone corresponding to a selected one of the plurality of filter zones while simultaneously operating the flow control valve to obstruct the flow of exhaust gas through said selected one of the plurality of filter zones to achieve a low flowrate of the exhaust gas through said selected one of the plurality of filter zones; and then deactivate the heating element and continue to operate the flow control valve to obstruct the flow of exhaust gas through said selected one of the plurality of filter zones to achieve the low flowrate of the exhaust gas through said selected one of the plurality of filter zones;

wherein the low flowrate of the exhaust gas comprises a flowrate suitable to propagate a soot oxidation front through said selected one of the plurality of filter zones after deactivating the heating element.

9. The device of claim 8, wherein operating the flow control valve to obstruct the flow of exhaust gas through said selected one of the plurality of filter zones and activation of the heating zone corresponding to a selected one of the plurality of filter zones achieves an exhaust gas temperature greater than 600° C. through the selected one of the plurality of filter zones.

* * * * *